United States Patent [19]

Avrahami et al.

[11] Patent Number: 4,961,885

[45] Date of Patent: Oct. 9, 1990

[54] ULTRASONIC NEBULIZER

[75] Inventors: Zohar Avrahami, Rehovot; Dov Larom, Herzelia Pituach; Shlomo Zucker, Yavne; Joseph Gross, Moshav Mazor, all of Israel

[73] Assignees: Elecsys Ltd., Herzlia; Product Development(Z.G.S)Ltd., Tel Aviv, both of Israel

[21] Appl. No.: 440,960

[22] Filed: Nov. 24, 1989

[51] Int. Cl.[5] ..... B01F 3/04

[52] U.S. Cl. ..... 261/142; 261/26; 261/81; 261/30; 261/DIG. 48; 239/102.2; 239/373

[58] Field of Search ..... 261/26, 81, 142, 30, 261/DIG. 48; 239/102.2, 373

[56] References Cited

U.S. PATENT DOCUMENTS

| | | | |
|---|---|---|---|
| 3,026,045 | 3/1962 | Reading | 239/373 |
| 3,077,900 | 2/1963 | Ehrmann et al. | 239/373 |
| 3,970,250 | 7/1976 | Drews | 239/102.2 |
| 4,294,407 | 10/1981 | Reichl et al. | 239/102.2 |
| 4,474,326 | 10/1984 | Takahashi | 239/102.2 |
| 4,776,990 | 10/1988 | Verity | 261/DIG. 48 |

*Primary Examiner*—Tim Miles

*Attorney, Agent, or Firm*—Benjamin J. Barish

[57] ABSTRACT

An ultrasonic nebulizer includes a supply container for the liquid to be nebulized, and an electrolytic cell having electrodes for generating a gas according to the amount of electricity conducted through the electrodes. The generated gas is effective to control the pressure in, or volume of, the supply container, and thereby the feed of the liquid therefrom to the ultrasonic nebulizer nozzle.

20 Claims, 2 Drawing Sheets

ULTRASONIC NEBULIZER

BACKGROUND OF THE INVENTION

The present invention relates to an ultrasonic nebulizer for nebulizing, or atomizing a liquid, and particularly to such nebulizers as are commonly used in air humidifiers, air heaters, and the like.

One known type of ultrasonic nebulizer includes an ultrasonic device (e.g., a piezoelectric crystal) which is immersed in the liquid (e.g., water) to be nebulized and which produces a spout of highly-agitated liquid. This type of nebulizer requires a large amount of energy because of the need to agitate a large body of liquid. The electronic circuit for supplying the ultrasonic device is therefore large and expensive. In addition, this type of nebulizer requires a liquid-level sensor to turn-off the power to the ultrasonic device if the liquid level drops below the ultrasonic device, to prevent its burn-out.

Another type of ultrasonic nebulizer includes an ultrasonic nebulizer nozzle and a container for the liquid to be nebulized, which container is disposed above the nozzle and includes a capillary tube for feeding the liquid from the bottom of the container to the nozzle by gravity. While such a nebulizer requires less energy than the immersion type, and therefore a simpler and less expensive power supply, the rate of feeding of the liquid via the capillary tube is difficult to control; moreover, the capillary tube tends to clog.

OBJECTS AND SUMMARY OF THE INVENTION

An object of the present invention is to provide an ultrasonic nebulizer having advantages in the above respects.

According to the present invention, there is provided a nebulizer including a supply container for liquid to be nebulized, an ultrasonic nebulizer nozzle for nebulizing the liquid, and feeding means for feeding the liquid from the supply container to the ultrasonic nebulizer nozzle; characterized in that the feeding means comprises: an electrolytic cell including electrodes for generating a gas according to the amount of electricity conducted through the electrodes; a feed tube leading from the supply container to the ultrasonic nebulizer nozzle for feeding liquid thereto according to the amount of gas generated by the electrodes; and control means for controlling the current flowing through the electrodes, and thereby the quantity of ga generated by the electrodes.

In the described preferred embodiments, the supply container is a closed container and is located below the ultrasonic nebulizer nozzle; also, the feed tube has an inlet end adapted to be immersed in the liquid in the supply container and an outlet end located adjacent to the ultrasonic nebulizer nozzle.

Three embodiments of the invention are described below for purposes of example.

In one described embodiment, the electrodes are immersed in the liquid in the supply container so as to increase the pressure therein, and thereby to feed liquid therefrom via the feed tube to the ultrasonic nebulizer nozzle, according to the amount of gas generated by the electrodes.

In a second described embodiment, the nebulizer includes a second container for a second liquid, and the electrodes are located in the second container for immersion in the liquid therein so as to increase the pressure in the second container according to the quantity of gas generated by the electrodes. The second container is coupled to the supply container to transfer thereto the pressure in the second container, and thereby to control the feeding of liquid therefrom to the ultrasonic nebulizer nozzle according to the pressure in the second container.

In a third described embodiment, the supply container includes a displaceable partition dividing its interior into first and second expansible chambers. One of the chambers contains the feed tube and is adapted to be filled with the liquid to be nebulized; while the other chamber contains the electrodes and is adapted to expand, and thereby to contract the first chamber, according to the quantity of gas generated by the electrodes.

It will thus be seen that a nebulizer constructed in accordance with the foregoing features provides the advantages of both the above-described immersion-type and the nozzle type, but without their disadvantages. Thus, the novel nebulizer requires much less energy, and therefore a smaller and simpler power supply, than the immersion type since it agitates a relatively smaller quantity of liquid. In addition, it permits relatively simple control of the rate of nebulization by controlling the electrical energy supplied to the electrodes. Further, it exhibits a lower sensitivity to clogging because the liquid is not fed by gravity via a capillary tube, but rather by a positive pressure via a feed tube, which may be of substantially larger diameter than a capillary tube.

Still further features and advantages of the invention will be apparent from the description below.

BRIEF DESCRIPTION OF THE DRAWINGS

The invention is herein described, by waY of example only, with reference to the accompanying drawings, wherein.

DESCRIPTION OF PREFERRED EMBODIMENTS

Figure 1:
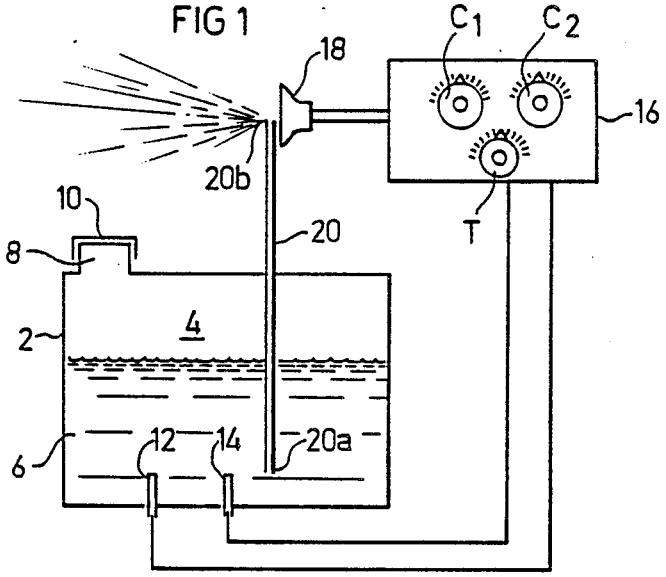
FIG. 1 illustrates one form of nebulizer constructed in accordance with the present invention.
Figure 2:
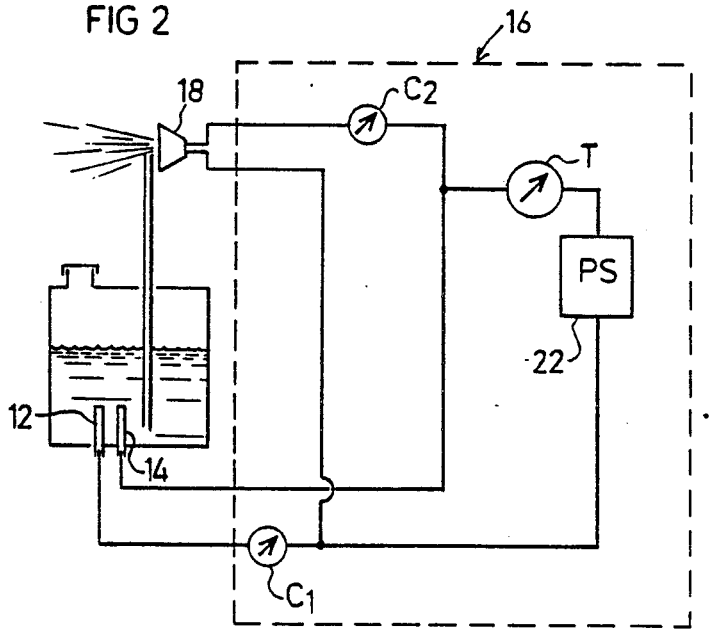
FIG. 2 is a circuit diagram illustrating a simplified electrical power supply and control circuit that may be used with the nebulizer of FIG. 1.

Embodiment of FIGS. 1 and 2

The nebulizer illustrated in FIG. 1 comprises a supply container 2 which is closed to define a closed chamber 4 for receiving water or other liquid 6 to be nebulized. The water is introduced into the container via a refill port 8 closed by cap 10.

A pair of electrodes 12, 14, are disposed at the bottom of chamber 4 so as to be immersed within the water 6 in the chamber. The two electrodes are connected to an electrical power supply unit 16. This unit supplies electrical power to the two electrodes 12, 14, at a controlled rate, causing them to generate gas by electrolysis and thereby to increase the pressure within chamber 4 at a controlled rate.

Power supply 16 also supplies power to the ultrasonic nebulizer nozzle 18 located above container 2. The water is fed from container 2 to the nozzle via a feed tube 20 having its lower end 20*a* located near the bottom of the container 2 so as to be immersed in the water 6 in the container, and its upper end 20*b* located adjacent to the ultrasonic nebulizer nozzle 18. It will thus be seen that the pressure generated within the closed chamber 4 will pump the water through the feed tube 20 to the ultrasonic nebulizer nozzle 18, and such water will be nebulized by the ultrasonic device, e.g., piezoelectric crystal, included in the nozzle.

Nozzle 18 may be one of known construction commonly used in the previously-mentioned capillary-tube type of ultrasonic nebulizers, and therefore details of its construction and operation are not set forth herein.

FIG. 2 more particularly illustrates one form of power supply unit 16 which may be used for supplying power to the two electrodes 12, 14, as well as to the ultrasonic device in the nozzle 18. Thus, unit 16 includes a power source 22 and three presettable control elements $C_1$, $C_2$ and T. Control element $C_1$ may be preset to control the amount of current supplied to the two electrodes 12, 14 within container 2; control element $C_2$ may be preset to control the amount of power supplied to the ultrasonic device within nozzle 18; and timer T may be preset to fix the time period during which the nebulizer is to operate.

The operation of the nebulizer illustrated in FIGS. 1 and 2 will be apparent from the above description. Thus, water or other liquid to be nebulized is introduced into container 2 via refill port 8, and cap 10 is then applied to the refill port to completely close chamber 4 within the container. Electrical current may then be supplied to the two electrodes 12, 14, immersed within the liquid 6 in container 2. The electrical current generates a gas (e.g., oxygen and hydrogen if the liquid is water, but other gasses where other liquids are used) by electrolysis, which gas increases the pressure within the closed chamber 4. This increased pressure pumps water via feed tube 20 to its outlet end 20*b* adjacent to nozzle 18, and such water is nebulized by the ultrasonic nebulizer within the nozzle.

It will be seen that the rate of feed of the water via feed tube 22 to the nozzle 18 can be preset by knob $C_1$ which controls the amount of current supplied to the two electrodes 12, 14, and thereby the rate of generation of the gas within the closed compartment 4 and the pressure build-up within that compartment. It will also be seen that the power supplied to the ultrasonic device within nozzle 18 is relatively low because of the small quantity of water to be agitated by the ultrasonic device; this power can also be controlled, by knob $C_2$. Timer knob T may be used for presetting the period of operation of the device. It will further be seen that the feed tube 20 will have a very low sensitivity to clogging because it may be of larger diameter than the capillary-tube used in the gravity-feed type devices, and also because of the positive pressure produced in the feed tube.

Figure 3:
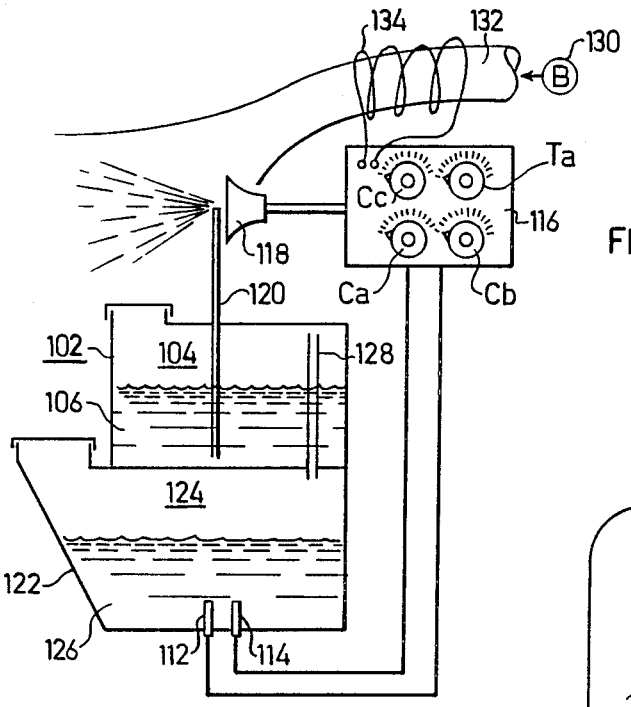
FIGS. 3 and 4 illustrate two further forms of nebulizer constructed in accordance with the present invention.

Embodiment of FIG. 3

FIG. 3 illustrates another nebulizer constructed in accordance with the present invention wherein the electrodes used for generating the gas are not immersed in the liquid which is actually fed to the nebulizer nozzle, but rather are immersed in another liquid contained in another closed chamber which is fluid-coupled to the chamber containing the liquid to be nebulized. Such an arrangement may be desired where the liquid to be nebulized is to include a medication or other ingredient which might be deleteriously affected by the electrical current used for generating the pumping pressure.

Thus, the nebulizer illustrated in FIG. 3 includes a container 102 defining a closed chamber 104 and containing the liquid 106 to be nebulized. Container 102 further includes a feed tube 120 through which the liquid is pumped by the pressure within the closed chamber 104 to the ultrasonic nebulizer nozzle 108.

In the construction illustrated in FIG. 3, the two electrodes 112, 114, which control the pumping of the liquid via feed tube 120 to the nebulizer nozzle 118, are disposed in a second container 122 defining a second closed chamber 124 containing a second liquid 126 immersing the two electrodes 112, 114. Chamber 124 is connected to chamber 104 by a conduit 128 such that the pressure within chamber 124 is also applied to chamber 104. The supply of electrical current to the two electrodes 112, 114, and also to the ultrasonic device within the nozzle 118, is controlled by a power supply unit 116 having three presettable control knobs $C_a$, $C_b$ and Ta, corresponding to knobs $C_1$, $C_2$ and T in FIGS. 1 and 2.

The nebulizer of FIG. 3 further includes blower means, comprising a blower 130 and a conduit 132, for directing a stream of air to flow through a path to pick up the liquid nebulized by the nozzle 118. This stream of air is first heated by a heater 134 applied around the conduit 132. The amount of heat applied to this stream of air can be controlled by a further control knob $C_c$ in the power supply unit 116.

The nebulizer illustrated in FIG. 3 operates in substantially the same manner as described above with respect to FIGS. 1 and 2, except that it heats the atomized liquid discharged from nozzle 118, and also isolates the two electrodes 112, 114 from the liquid 106 fed to be nebulized. Thus, liquid 126 immersing the electrodes may be water, whereas liquid 106 to be nebulized may also be water or another liquid containing a medication or other ingredient which might be affected by the electrodes, or by the electrical current passing through the electrodes. The nebulizer illustrated in FIG. 3 is thus particularly useful for therapeutic purposes in order to apply a stream of humidified hot air, with or without medicaments, e.g., to the nostrils of the user.

It will be appreciated that heater 134 could also be applied to the embodiment illustrated in FIGS. 1 and 2 (or FIG. 4 described below) if it is desired to heat the nebulized liquid.

Figure 4:
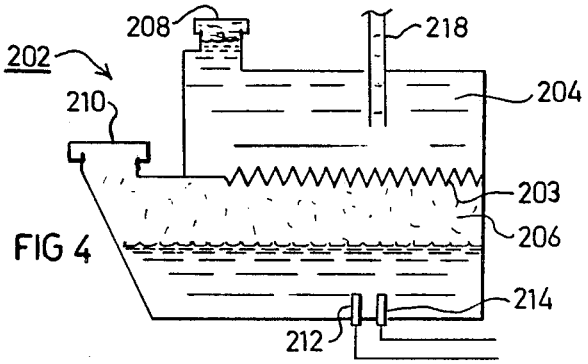

Embodiment of FIG. 4

FIG. 4 illustrates a further embodiment of the invention, wherein the nebulizer includes a container, generally designated 202, and a displaceable partition 203 dividing the interior of the container into two expansible chambers 204, 206. Chamber 204 includes a refill port closed by cap 208 for completely filling that chamber with the liquid to be nebulized, and compartment 206 similarly includes a refill port closed by cap 210 for partially filling the chamber with another liquid. The two electrodes 212, 214 are located in the bottom of chamber 206; and the feed tube 218 is disposed in chamber 204, with its inlet end located so as to be completely immersed in the liquid within that chamber, and its outlet end located adjacent to the ultrasonic nebulizer nozzle, e.g., corresponding to nozzle 118 in FIG. 3.

It will thus be seen that the feeding of the liquid from chamber 204 to the nozzle may be controlled by controlling the amount of electricity applied to the two electrodes 212, 214. Thus, as more current is passed through these electrodes, and the liquid in chamber 206 in which they are immersed, a gas is generated to increase the pressure of chamber 206. This causes chamber 206 to expand, and thereby chamber 204 to contract, so as to force liquid from the latter chamber through feed tube 218 to the nebulizer nozzle.

In the example illustrated in FIG. 4, the displaceable partition 203 is in the form of a flexible diaphragm. It will be appreciated, however, that it could be in other forms, e.g., a bellows, or a piston displaceable in a cylinder containing the liquid to be fed to the nebulizer nozzle.

Figure 5:
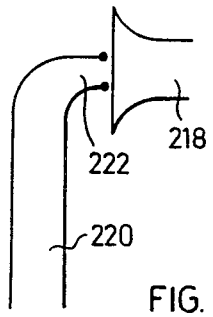
FIGS. 5–7 are enlarged fragmentary views illustrating various constructions of the outlet end of the feed tube which may be used in the nebulizers of FIGS. 1–4.
Figure 6:
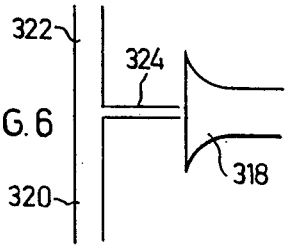
Figure 7:
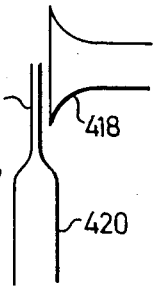

Variations of FIGS. 5–7

FIGS. 5–7 illustrate various constructions which may be used for the outlet end of the feed tube, e.g., feed tube 20 in FIGS. 1 and 2, feed tube 120 in FIG. 3, or feed tube 218 in FIG. 4.

In FIG. 5, the upper end of the feed tube 220 terminates in an outlet at substantially the same level as the nozzle 218, but includes a bend 222 which is turned towards the nozzle so as to direct the liquid pumped through the feed tube into more intimate contact with the ultrasonically-vibrating element of the nozzle.

In FIG. 6, the upper end of the feed tube 320 terminates in an outlet slightly above that of the nozzle 318, as shown by outlet 322, but includes another outlet 324 at the level of, and turned towards, the nozzle. Such an arrangement prevents or minimizes dripping of the liquid from the upper end of the feed tube caused by the residual pressure in the liquid supply chamber (e.g., 4, FIG. 1) after the ultrasonic element in the nozzle (e.g., 18) has been deenergized.

FIG. 7 illustrates a construction wherein the upper end of the feed tube 420 is reduced in diameter to produce a capillary tube outlet 422 adjacent to the nozzle 418.

Many other variations, modifications and applications of the invention will be apparent.

What is claimed is:

1. A nebulizer including a supply container for liquid to be nebulized, an ultrasonic nebulizer nozzle for nebulizing the liquid, and feeding means for feeding the liquid from the supply container to the ultrasonic nebulizer nozzle; characterized in that said feeding means comprises:

an electrolytic cell including electrodes for generating a gas according to the amount of electricity conducted through said electrodes;

a feed tube leading from said supply container to said ultrasonic nebulizer nozzle for feeding liquid thereto according to the amount of gas generated by said electrodes; and control means for controlling the current flowing through said electrodes, and thereby the quantity of gas generated.

2. The nebulizer according to claim 1, wherein said control means further includes an electrical circuit for controlling the power supplied to said ultrasonic nebulizer nozzle.

3. The nebulizer according to claim 1, further including blower means for directing a stream of air through a path to pick up the liquid nebulized by said ultrasonic nebulizer nozzle.

4. The nebulizer according to claim 3, wherein said blower means includes a heater for heating said stream of air.

5. The nebulizer according to claim 4, wherein said blower means includes a blower and a conduit through which the steam of air flows before picking up the liquid nebulized by said ultrasonic nebulizer nozzle, said heater being located to heat the air flowing through said conduit.

6. The nebulizer according to claim 1, wherein said supply container is a closed container and is located below said ultrasonic nebulizer nozzle, said feed tube having an inlet end adapted to be immersed in the liquid in the supply container and an outlet end located adjacent to said ultrasonic nebulizer nozzle.

7. The nebulizer according to claim 6, wherein said electrodes are immersed in the liquid in said supply container so as to increase the pressure in said supply container, and thereby to feed liquid therefrom via said feed tube to the ultrasonic nebulizer nozzle according to the amount of gas generated by said electrodes.

8. The nebulizer according to claim 6, further including a second container for a second liquid, said electrodes being located in said second container for immersion in the liquid therein so as to increase the pressure in said second container according to the quantity of gas generated by said electrodes; said second container being fluid coupled to said supply container to transfer thereto the pressure in said second container, and thereby to control the feeding of liquid therefrom to the ultrasonic nebulizer nozzle according to the pressure in said second container.

9. The nebulizer according to claim 6, wherein the upper end of said feed tube terminates in an outlet slightly above the ultrasonic nebulizer nozzle and includes another outlet slightly below the first-mentioned outlet and turned towards the nozzle.

10. The nebulizer according to claim 6, wherein the outlet at the upper end of the feed tube is of reduced diameter to produce a capillary-tube outlet adjacent said nozzle.

11. The nebulizer according to claim 6, wherein the upper end of said feed tube terminates in an outlet at substantially the same elevation as the ultrasonic nebulizer nozzle.

12. The nebulizer according to claim 11, wherein the outlet at the upper end of said feed tube is turned towards the ultrasonic nebulizer nozzle.

13. The nebulizer according to claim 6, wherein said supply container includes a displaceable partition dividing its interior into first and second expansible chambers; one of said chambers containing said feed tube and adapted to be filled with the liquid to be nebulized; the other of said chambers containing said electrodes and adapted to expand, and thereby to contract said first chamber, according to the quantity of gas generated by said electrodes.

14. The nebulizer according to claim 13, wherein said displaceable partition is a flexible diaphragm.

15. The nebulizer according to claim 14, wherein said control means further includes a presettable timer for controlling the time during which electrical current is supplied to said electrodes.

16. A nebulizer for producing a flow of heated air containing a nebulized liquid, comprising:

a supply container for the liquid to be nebulized;

an ultrasonic nebulizer nozzle for nebulizing the liquid;

an electrolytic cell including electrodes for generating a gas according to the amount of electricity conducted through said electrodes;

a feed tube leading from said supply container to said ultrasonic nebulizer nozzle for feeding liquid to said nozzle according to the amount of gas generated by said electrolytic cell;

an electrical circuit for controlling the current flow through said electrodes and thereby the quantity of gas generated by said electrodes;

blower means for directing a stream of air to flow through a path to pick up the liquid nebulized by said nozzle; and a heater for heating said stream of air.

17. The nebulizer according to claim 16, wherein said supply container is a closed container and is located below said ultrasonic nebulizer nozzle, said feed tube having an inlet end adapted to be immersed in the liquid in the supply container and an outlet end located adjacent to said ultrasonic nebulizer nozzle.

18. The nebulizer according to claim 16, wherein said electrodes are immersed in the liquid in said supply container so as to increase the pressure therein, and thereby to feed liquid therefrom via said feed tube to the ultrasonic nebulizer nozzle, according to the amount of gas generated by said electrodes.

19. The nebulizer according to claim 16, further including a second container for a second liquid, said electrodes being located in said second container for immersion in the liquid therein so as to increase the pressure in said second container according to the quantity of gas generated by said electrodes; said second container being fluid coupled to said supply container to transfer thereto the pressure in said second container, and thereby to control the feeding of liquid therefrom to the ultrasonic nebulizer nozzle according to the pressure in said second container.

20. The nebulizer according to claim 16, wherein said supply container includes a displaceable partition dividing its interior into first and second expansible chambers; one of said chambers containing said feed tube and adapted to be filled with the liquid to be nebulized; the other of said chambers containing said electrodes and adapted to expand, and thereby to contract said first chamber, according to the quantity of gas generated by said electrodes.

* * * * *